US010805749B2

(12) United States Patent
Arnold et al.

(10) Patent No.: US 10,805,749 B2
(45) Date of Patent: Oct. 13, 2020

(54) METHOD FOR OPERATING A HEARING AID DEVICE, AND HEARING AID DEVICE

(71) Applicant: SIVANTOS PTE. LTD., Singapore (SG)

(72) Inventors: Mirko Arnold, Erlangen (DE); Stefan Petrausch, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 15/913,065

(22) Filed: Mar. 6, 2018

(65) Prior Publication Data

US 2018/0262854 A1 Sep. 13, 2018

(30) Foreign Application Priority Data

Mar. 9, 2017 (DE) ..... 10 2017 203 947

(51) Int. Cl.
*H04R 25/00* (2006.01)

(52) U.S. Cl.
CPC ..... *H04R 25/75* (2013.01); *H04R 2460/01* (2013.01); *H04R 2460/09* (2013.01)

(58) Field of Classification Search
CPC . H04R 25/00; H04R 2225/49; H04R 2460/01
USPC ..... 381/312, 317
See application file for complete search history.

(56) References Cited

U.S. PATENT DOCUMENTS 5,721,783 A * 2/1998 Anderson ..... H04B 1/385 381/328
6,047,074 A 4/2000 Zoels et al.
8,265,314 B2 * 9/2012 Schumaier ..... H04R 25/70 381/323
9,712,933 B2 7/2017 Pontoppidan
2005/0251226 A1 11/2005 D'Angelo
2007/0237347 A1 10/2007 Pfeiler
2012/0046713 A1 2/2012 Hannemann et al.
2017/0289708 A1 * 10/2017 Nielsen ..... A61B 5/128

FOREIGN PATENT DOCUMENTS

CN 102821346 A 12/2012
CN 202859447 U 4/2013
CN 103096230 A 5/2013
CN 103784253 A 5/2014
DE 102006016440 A1 10/2007

(Continued)

OTHER PUBLICATIONS

Strauss, D.J., et al., Notched environmental sounds: a new hearing aid-supported tinnitus treatment evaluated in 20 patients, Oct. 22, 2015, pp. 172-175.

(Continued)

*Primary Examiner* — Suhan Ni
(74) *Attorney, Agent, or Firm* — Laurence A. Greenberg; Werner H. Stemer; Ralph E. Locher

(57) ABSTRACT

A method operates a hearing aid device, in particular a tinnitus treatment device. The hearing device has a microphone and a receiver, which can be inserted into an auditory canal of a user or is arranged at least in part in the auditory canal. Wherein active noise control of an acoustic environmental signal, which can be received by the microphone, is achieved at one or more tinnitus frequencies of a user by generating an acoustic cancellation signal from the receiver in the auditory canal of the user.

4 Claims, 1 Drawing Sheet

(56) References Cited

FOREIGN PATENT DOCUMENTS

| | | | |
|---|---|---|---|
| EP | 0820211 | A1 | 1/1998 |
| EP | 2533550 | B1 | 1/2014 |
| EP | 2421282 | B1 | 10/2016 |

OTHER PUBLICATIONS

Gorski, Pawel, et al., Active Noise Reduction Algorithm Based on NOTCH Filter and Genetic Algorithm, 2013, pp. 185-190.

* cited by examiner

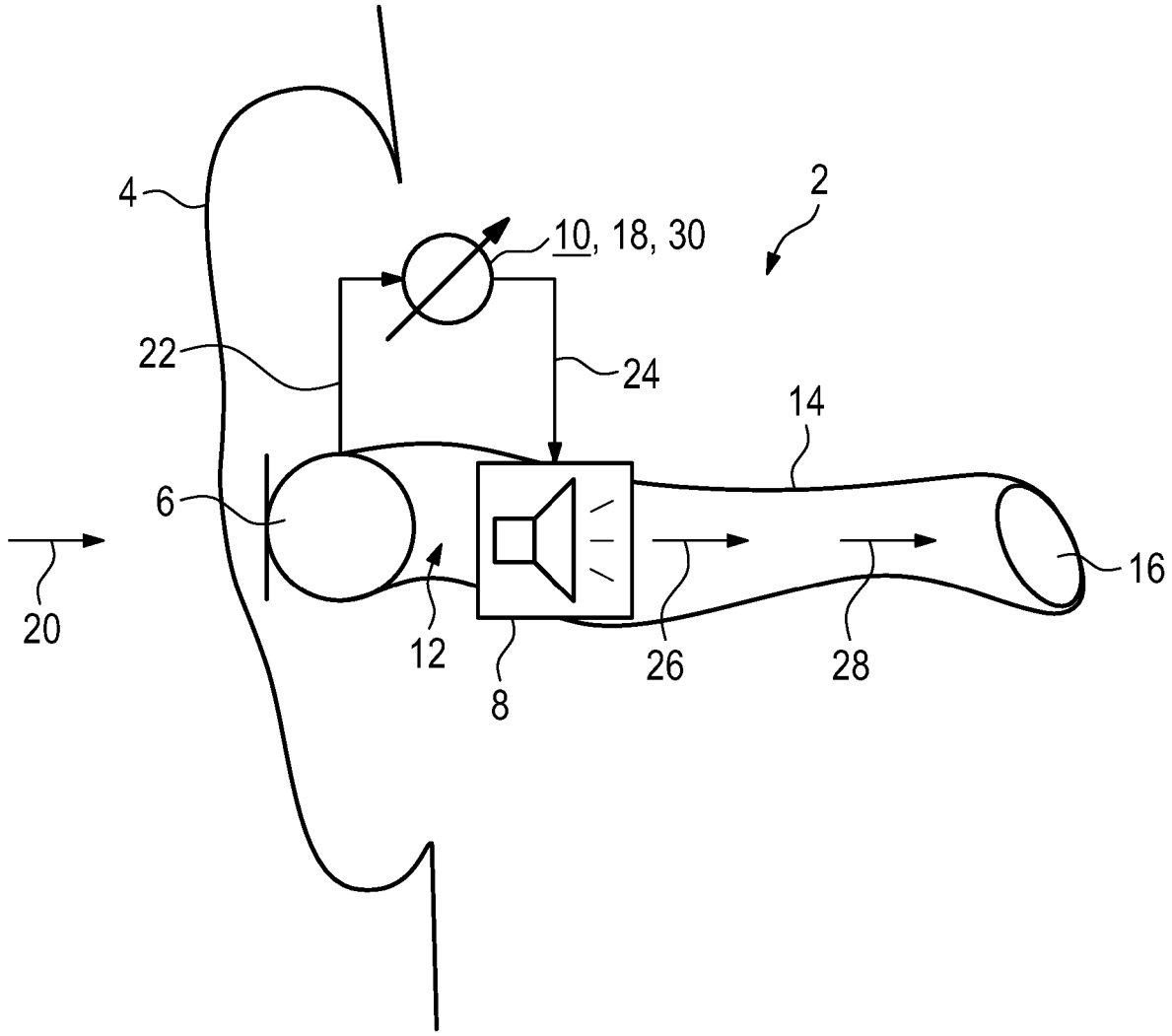
4
2
10, 18, 30
22
24
14
6
16
20
12
8
26
28

METHOD FOR OPERATING A HEARING AID DEVICE, AND HEARING AID DEVICE

CROSS-REFERENCE TO RELATED APPLICATION

This application claims the benefit, under 35 U.S.C. § 119, of German patent application DE 10 2017 203 947.7, filed Mar. 9, 2017; the prior application is herewith incorporated by reference in its entirety.

BACKGROUND OF THE INVENTION

Field of the Invention

The invention relates to a method for operating a hearing aid device, in particular a tinnitus treatment device, containing a microphone and a receiver which can be introduced into an auditory canal of a user or is arranged at least in part in the auditory canal. The invention also relates to a hearing aid device that can be operated according to such a method.

Hearing aid devices are portable hearing devices that are used to assist people who have impaired hearing or poor hearing. In order to accommodate the numerous individual needs, different designs of hearing aid devices are provided such as behind-the-ear (BTE) hearing aids and hearing aids having an external receiver (RIC: receiver in the canal) and also in-the-ear (ITE) hearing aids, for instance also concha hearing aids or in-the-canal hearing aids (ITE: In-The-Ear, CIC: completely-in-canal, IIC: invisible-in-canal). The hearing aids cited by way of example are worn on the outer ear or in the auditory canal of a hearing-aid device user. In addition, however, there are also bone-conduction hearing aids, implant hearing aids or vibrotactile hearing aids available on the market. In these hearing aids, stimulation of the impaired hearing is performed either mechanically or electrically.

Such hearing devices basically have as essential components an input transducer, an amplifier and an output transducer. The input transducer is typically an acousto-electric transducer such as a microphone, for example, and/or an electromagnetic receiver, for instance an induction coil or an (radio frequency, RF) antenna. The output transducer is usually implemented as an electro-acoustic transducer, for instance as a miniature loudspeaker (receiver), or as an electromechanical transducer such as a bone conduction receiver, for example. The amplifier is usually integrated in a signal processing unit. Power is normally supplied by a non-rechargeable or rechargeable battery.

Severe hearing loss as hearing impairment often triggers neuroplastic reorganization of the central auditory system in the brain of the sufferer, and is therefore often a trigger and a cause of (chronic) tinnitus occurring.

Tinnitus is generally understood to refer to all forms of sounds in the head or ear that are not caused by acoustic signals from the environment carried into the ear. Tinnitus is also classified here into "subjective tinnitus" or "objective tinnitus".

Objective or physical tinnitus is caused by a sound source present in the body, in particular in the inner ear, of the sufferer. The acoustic emissions from this sound source are measurable in the auditory canal as spontaneous otoacoustic emissions (SOAE).

With subjective or non-physical tinnitus, there is no such sound source and hence it cannot be measured. Subjective tinnitus can be perceived only by the sufferers themselves, and is mostly caused by misdirected nerve activity in auditory and other parts of the brain, which, for example, is the result of the above-described neuroplastic reorganization of the central auditory system.

Although tinnitus is not dangerous, it does have a severe depressive effect on many sufferers. Thus in particular chronic tinnitus often results in serious psychological problems and hence also has a negative impact on the professional and social life of the person affected. In addition, for example, it affects concentration and causes sleep problems.

Noise generators (Tinnitus-Noiser, audiostimulator, tinnitus control instrument, tinnitus masker) are often used as part of a tinnitus treatment. In this treatment, a tinnitus treatment device known as a masker and similar to a hearing aid device presents to the patient a soft, less disturbing sound as an acoustic signal.

Since chronic tinnitus often occurs together with hearing loss, such tinnitus treatment devices are usually integrated as an additional function in hearing devices or hearing aid devices. The acoustic signal is generated at a signal frequency, for example, that equals approximately the perceived tinnitus frequency and thus is meant to conceal ("mask") the tinnitus.

The article entitled "Notched Environmental Sounds: A New Hearing Aid Supported Tinnitus Treatment Evaluated in 20 Patients" (D. J. Strauss et. al, Clinical Otolaryngology, 2015) describes a treatment procedure (notched tinnitus therapy) in which the hearing aid device and/or tinnitus treatment device uses a microphone to receive an acoustic environmental signal, and filters out the, or each, tinnitus frequency as part of signal processing. A receiver outputs the filtered signal as an acoustic output signal to the user.

In order to perform the disclosed method, it is therefore necessary that the environmental signal itself does not get into the auditory canal of the user, so that the user perceives only the filtered output signal. This requires the use of hearing aid devices that substantially completely close (acoustically) the auditory canal of the user, thereby blocking the entry of the sound from the environmental signal into the auditory canal. This has the disadvantage, however, of causing what is known as the occlusion effect. This is undesirable in particular for sufferers of tinnitus who do not have substantial hearing impairment.

European patent EP 2 421 282 B1, corresponding to U.S. patent publication No. 2012/0046713, discloses a hearing aid device in which an acoustic output signal is generated in which one or more tinnitus frequencies of the user are suppressed. This facilitates a neuroplastic reorganization of the central auditory system of the sufferer, which reverses again the maladaptive neuroplastic reorganization of the central auditory system of the sufferer that is causing the tinnitus. It is disclosed here, for example, that a tinnitus masking signal is generated in which the tinnitus frequency/frequencies are filtered out (suppressed) using notch filters or bandpass filters.

U.S. patent disclosure No. 2005/0251226 A1 describes a hearing aid device as a tinnitus treatment device. The disclosed hearing aid device is configured in this case for treating objective tinnitus. For this purpose, a microphone is used to detect the sound produced from the otoacoustic emission. A cancellation signal or noise cancelling signal is generated from the detected (tinnitus) sound signal by a receiver in the auditory canal, thereby suppressing the otoacoustic emissions of the objective tinnitus.

SUMMARY OF THE INVENTION

The object of the invention is to define a particularly suitable method for operating a hearing aid device. Another object of the invention is to define a hearing aid device suitable for performing such a method.

With regard to the method, the object is achieved according to the invention by the features of the main method claim, and with regard to the hearing aid device by the features of the main device claim. Advantageous embodiments and developments form the subject matter of the various dependent claims.

The method according to the invention is suitable, and configured, for operating a hearing aid device, in particular a tinnitus treatment device. The hearing aid device comprises a microphone and a receiver, which is arranged at least in part in an (external) auditory canal of a user or can be inserted (introduced) into the auditory canal. In other words, the receiver is intended and designed to be inserted in the auditory canal of a user.

According to the method, active noise control (ANR: active noise reduction; ANC: active noise cancellation) of an acoustic environmental signal, which can be received by the microphone, is achieved at one or more tinnitus frequencies of a user by generating an acoustic cancellation signal from the receiver in the auditory canal of the user. The acoustic cancellation signal is also referred to below as a noise cancelling signal.

In other words, in order to reduce the tinnitus sensitivity, active noise control is provided, which seeks, by additional emission of the acoustic cancellation signal by the receiver, to eliminate or at least suppress or attenuate the, or each, tinnitus frequency by superposition of the cancellation signal with the acoustic environmental signal in the auditory canal. This means that the receiver outputs an acoustic cancellation signal which, on superposition with the environmental signal, produces in the auditory canal of the user a resultant total signal in which the, or each, tinnitus frequency of the user is suppressed or at least reduced. It is thereby possible to attenuate effectively in particular (tinnitus) frequencies having frequency values of less than 2 kHz (kilohertz).

The hearing aid device is configured to suppress or reduce a perceived subjective tinnitus (non-physical tinnitus). This means that the, or each, tinnitus frequency is a tinnitus frequency subjectively perceived by the sufferer. The subjective tinnitus frequencies of the sufferer are therefore not caused by a measurable sound source. In other words, the term tinnitus is intended in particular to refer to subjective tinnitus, and the term tinnitus frequency is intended in particular to refer to a corresponding (subjective) tinnitus frequency of said subjective tinnitus. Thus unlike the prior art, the active noise control is not performed using a cancellation signal for an otoacoustic emission of objective tinnitus. Instead, the cancellation signal suppresses or reduces the, or each, (subjective) tinnitus frequency in an environmental signal coming to the ear from outside in such a way that facilitates neuroplastic reorganization of the central auditory system of the sufferer.

This achieves a particularly suitable method for operating the hearing aid device. Unlike the prior art, the hearing aid device thus does not block the auditory canal of the user to sound, so that in addition to the cancellation signal generated by the receiver, the acoustic environmental signal also gets into auditory canal. This significantly improves the sound quality and bandwidth of the (total) acoustic signal perceived by the user, because in this case the signal is not merely a filtered (amplified) acoustic output signal from the hearing aid device. In addition, the occlusion effect is thereby prevented substantially in full. This is advantageous in particular for users who have little or no hearing impairment, because this allows a more natural sound from the environment.

Furthermore, unlike the prior art, instead of an acoustic masking signal to mask the tinnitus frequencies, an acoustic cancellation signal is generated which, in interaction or superposition with the acoustic environmental signal, causes suppression or reduction of the tinnitus frequencies.

The acoustic cancellation signal, or the noise cancelling signal, is generated here in particular as a phase-inverted acoustic signal. In other words, the noise cancelling signal is generated such that it equals a sound corresponding to the, or each, tinnitus frequency in the environmental signal with a polarity that is as exactly opposite as possible. This allows reliable elimination or suppression of the corresponding frequency bands in the perceived environmental signal in the auditory canal.

The hearing aid device according to the invention is configured in particular as a tinnitus treatment device. The hearing aid device is configured to have a microphone for receiving an acoustic environmental signal and converting this environmental signal into an electrical input signal, and to have a signal processing unit for processing the electrical input signal into an electrical output signal, and to have a receiver, which is arranged at least in part in an auditory canal of a user, for converting the electrical output signal into an acoustic cancellation signal. The acoustic cancellation signal is used here for the active noise control at the, or each, tinnitus frequency of the user.

For this purpose, the microphone detects an acoustic environmental signal, which is analyzed as an electrical input signal by the signal processing unit. The signal processing unit processes the electrical input signal into an electrical output signal, which is used to generate the acoustic cancellation signal. The acoustic cancellation signal generated by the receiver is superimposed on, or interferes with, the acoustic environmental signal in the auditory canal of the user in such a way that the sound pressure arising at an eardrum of the user is reduced or completely suppressed at the, or each, tinnitus frequency. The remaining sound spectrum or frequency spectrum of the acoustic environmental signal is substantially unchanged in the process, thereby ensuring a high sound quality for the user.

In an advantageous development, the, or each, tinnitus frequency of the user is stored in a memory of the signal processing unit. In order to acquire and determine the, or each, tinnitus frequency, it is ascertained at which frequency, or at which frequencies, the user perceives acoustic signals that are not caused by acoustic signals getting into the ear from outside (environmental signals). This acquisition is performed, for example, by a doctor or a hearing aid audiologist. The, or each, acquired tinnitus frequency is then stored in the memory of the signal processing unit.

During operation, the signal processing unit uses the, or each, stored tinnitus frequency to process the input signal. A suitable cancellation signal for eliminating or suppressing the tinnitus frequencies can thereby always be generated. In this process, the signal processing device preferably also takes into account the transmission path inside the hearing aid device including the phase differences that this causes between the environmental signal and the cancellation signal to be generated. For this purpose, for example, it is possible that a model of the acoustic transmission path of the hearing aid device is stored in the memory. The microphone and the receiver are preferably arranged as close as possible to one another in order to reduce any signal delays and phase differences as much as possible.

The signal processing unit preferably contains a controller (in other words a control device).

The controller is configured generally, in software and/or circuitry, to perform the above-described method according to the invention. Thus the controller is configured in particular, by adjusting a filter, to generate from the received input signal and the stored tinnitus frequencies, and preferably using a model of the transfer function of the hearing aid device, an electronic output signal that produces an acoustic cancellation signal from the receiver for active noise control of the tinnitus frequencies in the environmental signal.

The controller is formed, at least in essence, by a microcontroller having a processor and a data storage device, in which the functions for performing the method according to the invention are programmed in the form of operating software (firmware) so that the method—possibly in interaction with a user—is performed automatically when the operating software is executed in the microcontroller.

In a possible embodiment according to the invention, however, the controller is alternatively also formed by programmable electronic components, for instance an application specific integrated circuit (ASIC), in which the functions for performing the method according to the invention are implemented by circuitry.

In a possible embodiment, the controller is configured in particular to suppress effectively also tinnitus frequencies at frequency values greater than 2 kHz. Patients often already have significant hearing loss in this frequency band, with the result that even with an open auditory canal, i.e. an auditory canal in which sound is not blocked, significant attenuation of the tinnitus frequencies is already achieved. For users or patients without significant hearing loss, there is still the option to close the auditory canal by an acoustic filter that acoustically attenuate in particular frequencies greater than 2 kHz. The filter is configured, for example, as electronic filters, in particular notch filters.

In other words, the active noise control or the noise cancelling signal is used in particular for attenuating tinnitus frequencies less than about 2 kHz, and the filter for acoustic attenuation of the tinnitus frequencies of the environmental signal are provided in particular for frequencies greater than about 2 kHz. This facilitates effective suppression or attenuation of one or more tinnitus frequencies of the user substantially over the entire (audible) frequency spectrum.

An exemplary embodiment of the invention is described in greater detail below with reference to a drawing, in which the single FIGURE shows in a simplified schematic diagram a tinnitus treatment device worn on an ear of a user, which device comprises a microphone and a receiver and also contains a signal processing unit designed for active noise control.

Other features which are considered as characteristic for the invention are set forth in the appended claims.

Although the invention is illustrated and described herein as embodied in a method for operating a hearing aid device, and a hearing aid device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The single FIGURE of the drawing is an illustration of a tinnitus treatment device according to the invention.

DETAILED DESCRIPTION OF THE INVENTION

Referring now to the FIGURE of the drawings in detail and first, particularly to FIG. 1 thereof, there is shown a hearing aid device embodied as a tinnitus treatment device 2. The tinnitus treatment device 2 during operation is worn on an ear 4 of a user suffering from tinnitus. The tinnitus treatment device 2 has a microphone 6 as an acousto-electric transducer, and a receiver 8 as an electro-acoustic transducer, and also a signal processing unit 10, which is configured in particular for active noise control of one or more tinnitus frequencies.

The microphone 6 is arranged at an entrance 12 to an (external) auditory canal 14 of the ear 4. It is likewise also possible, however, that the microphone 6 is arranged at least in part inside the auditory canal 14. The receiver 8, however, is always positioned further inside or deeper in the auditory canal 14 than the microphone 6. The auditory canal 14 extends from the entrance 12 to an eardrum 16 of the user.

The, or each, tinnitus frequency of the user is stored in a memory 18 of the signal processing unit 10.

During operation of the tinnitus treatment device 2, active noise control is performed on an acoustic environmental signal 20 such that the, or each, tinnitus frequency stored in the memory 18 is suppressed or reduced. For this purpose, the tinnitus treatment device 2 has an open design, which means that the tinnitus treatment device 2 does not (entirely) block sound from the entrance 12 to the auditory canal 14. In other words, the acoustic environmental signal 20 gets into the auditory canal 14. In addition, the environmental signal 20 is received by the microphone 6 and converted into an electrical input signal 22.

The electrical input signal 22 is fed to the signal processing unit 10, which processes the signal into an electrical output signal 24. The electrical output signal 24 is fed to the receiver 8, which emits the signal as an acoustic cancellation signal (noise cancelling signal) 26 into the auditory canal 14. In the auditory canal 14, the acoustic environmental signal 20 and the acoustic cancellation signal 26 are superimposed on, or interfere with, one another to give a resultant total signal 28, which at the eardrum 16 exhibits a reduced sound pressure in the frequency band of the, or each, tinnitus frequency.

The acoustic cancellation signal 26 is here generated as phase-inverted acoustic signal of the acoustic environmental signal 20. This means that the acoustic cancellation signal 26, at least in the frequency band of the, or each, tinnitus frequency, equals a sound of the environmental signal 20 with a polarity that is as exactly opposite as possible.

The acoustic environmental signal 20 is detected by the microphone 6 for the purpose of active suppression of the, or each, tinnitus frequency. The signal processing unit 10 uses a model of an acoustic transfer function of the tinnitus treatment device 2, which model is stored in the memory 18, to calculate from the stored tinnitus frequency/frequencies the signal component of the environmental signal 20 that would still remain at the eardrum 16. The opposite-polarity acoustic cancellation signal 26 for this signal component is then generated in the receiver 8 for the purpose of cancellation.

The tinnitus treatment device 2 also contains a filter, for example in the form of electronic notch filters 30, for acoustic attenuation in particular of tinnitus frequencies greater than 2 kHz.

The sound from the acoustic environmental signal 20 coming from outside, and the acoustic cancellation signal 26 from the receiver 8 meet at the eardrum 16 as sound, or more specifically acoustic total signal 28. As a result of the acoustic cancellation signal 26, the resultant sound pressure level of the total signal 28 is in this case reduced or entirely suppressed in the band of the, or each, tinnitus frequency.

The invention is not limited to the exemplary embodiment described above. Indeed a person skilled in the art can also derive other variants of the invention therefrom without departing from the subject matter of the invention. Moreover, in particular all the individual features described in connection with the exemplary embodiment can also be combined with one another in other ways without departing from the subject matter of the invention.

The following is a summary list of reference numerals and the corresponding structure used in the above description of the invention:

2 hearing aid device/tinnitus treatment device
4 ear
6 microphone
8 receiver
10 signal processing unit
12 entrance
14 auditory canal
16 eardrum
18 memory
20 environmental signal
22 input signal
24 output signal
26 cancellation signal
28 total signal
30 filter means/notch filter

The invention claimed is:

1. A method for operating a hearing aid device having a microphone and a receiver being inserted into an auditory canal of a user or is disposed at least in part in the auditory canal, which comprises the steps of:

receiving an acoustic environmental signal via the microphone; and achieving active noise control of the acoustic environmental signal at at least one tinnitus frequency of the user by generating an acoustic cancellation signal from the receiver in the auditory canal of the user, the acoustic cancellation signal being phase-inverted in an area of the at least one tinnitus frequency, such that a sound pressure of a resulting complete signal is reduced.

2. A hearing aid device, comprising:

a microphone for receiving an acoustic environmental signal and converting the acoustic environmental signal into an electrical input signal;

a signal processing unit for processing the electrical input signal into an electrical output signal; and a receiver being inserted at least in part into an auditory canal of a user, for converting the electrical output signal into an acoustic cancellation signal, active noise control of the acoustic environmental signal is achieved at at least one tinnitus frequency of the user by generating the acoustic cancellation signal from said receiver in the auditory canal of the user, said acoustic cancellation signal being phase-inverted in an area of said at least one tinnitus frequency, such that a sound pressure of a resulting complete signal is reduced.

3. The hearing aid device according to claim 2, wherein:

said signal processing unit has a memory, the at least one tinnitus frequency of the user is stored in said memory; and said signal processing unit uses a stored tinnitus frequency to process the electrical input signal.

4. The hearing aid device according to claim 2, wherein the hearing aid device is a tinnitus treatment device.

* * * * *